US005390460A

United States Patent [19]

Llorens

[11] Patent Number: 5,390,460

[45] Date of Patent: Feb. 21, 1995

[54] ROOF SECURING SYSTEM

[76] Inventor: Mario Llorens, 310 W. 36th Ter., Hialeah, Fla. 33012

[21] Appl. No.: 46,434

[22] Filed: Apr. 16, 1993

[51] Int. Cl.[6] ..... E04B 9/00

[52] U.S. Cl. ..... 52/489.1; 52/715

[58] Field of Search ..... 52/712, 714, 715, 489.1, 52/483.1, 343, 357

[56] References Cited

U.S. PATENT DOCUMENTS

| | | | |
|---|---|---|---|
| 2,910,155 | 10/1959 | Bradner | 52/714 X |
| 3,782,058 | 1/1974 | Allen | 52/712 X |
| 3,972,169 | 8/1976 | Sheppard, Jr. | 52/715 X |
| 4,022,537 | 5/1977 | Gilb et al. | 52/715 X |
| 4,896,985 | 1/1990 | Commins | 52/712 X |

*Primary Examiner*—Lanna Mai
*Attorney, Agent, or Firm*—Malloy & Malloy

[57] ABSTRACT

A roof securing system to be used with a roof of the type having a plurality of support beams and a plurality of panels disposed in overlying spanning relation atop at least two support beams, the securing system including at least one strong, elongate strap with a top side and a bottom side, and including a central zone and pair of oppositely disposed distal zones, the central zone of the strap being adapted to span at least one of the panels such that the bottom side of the strap matingly overlies a top surface of the panel, the strap being securely fastened at its opposite distal zones to a bottom face and opposite side faces of one of the support beams such that the strap and panel are secured to the beam.

5 Claims, 2 Drawing Sheets

ROOF SECURING SYSTEM

BACKGROUND OF THE INVENTION

1. Field of the Invention

The present invention relates to a roof securing system adapted to secure a roofing panel such as plywood atop the roof support beams, thereby providing an effective additional reinforcement to maintain the panel properly positioned despite the exertion of upward lifting forces on the panel.

2. Description of the Related Art

Traditional roof structures such as those used in residential houses are typically constructed with spaced apart trusses which provide support beams upon which a number of individual plywood roofing panels are secured. The support beams are generally formed of wood, as are the roofing panels. The roofing panels are generally ¾ inch plywood panels, often having a generally large surface area and side edges which are disposed in abutting relation to one another atop the support beams. The individual panels are secured to the support beams by a plurality of nails disposed along opposite edges of the panel, thereby nailing the panel to the respective support beams. The roof structure is then often completed utilizing various leakage prevention and cosmetic additions such as the use of roofing paper tarred in position atop the panels and decorative roof tiles disposed thereon. The primary strength and structure of the roof assemblies are, however, the trusses and the plywood panels which in most circumstances are sufficient to support downward loads. Unfortunately, the panels may be subject to buckling if a heavy, substantial force is exerted on central portions of the plywood panel, resulting in separation of the nailed edges of the plywood panel from the support beams. Further, if heavy winds are present, such as those incurred during a hurricane, the substantial winds often enter a structure and push upwardly on the individual panels resulting in complete or partial separation of the individual panels from the support beams. Accordingly, it would be highly beneficial to have a roof securing system which would provide additional securing strength beyond that possible utilizing only the nails along the edges of the plywood panels.

The system of the present invention is designed specifically to add a significant degree of stability and security to roofing structures by strapping the roofing panels directly to the support beams. The system is adaptable for use with existing roofing procedures and provides the added strength needed to provide a safer and more secure roof structure.

SUMMARY OF THE INVENTION

The present invention is directed towards a roof securing system to add increased security and stability to roofing construction. The system is primarily adapted for use with a roof of a type including a number of support beams, each with a top face, a bottom face, and a pair of opposite side faces, and including a plurality of panels. The panels, which are primarily plywood sheets, are of the type having a top surface and a bottom surface and are disposed in overlying, spanning relation along the top edge of at least two of the support beams, thereby forming a roof structure. Specifically, the roof securing system includes at least one strong, elongate strap. The strap, which has a top side and a bottom side, is divided into a central zone and a pair of oppositely disposed distal zones. Preferably, the strap is made of 14 gauge steel for sufficient strength. The central zone of the strap is adapted to span at least one of the panels of the roof in a manner such that the bottom side of the strap matingly overlies the top surface of the panel. Each of the distal end zones, which extend beyond the panel, are adapted to define securing means. The securing means are configured for mating, secure engagement with the opposite side faces and the bottom face of one of the support beams. As a result of the wrap around securing of the distal end zones of the strap about faces of the support beams, the panels are securely held and positioned atop the support beams.

It is an object of the present invention to provide a roof securing system which is easily adapted for reinforcing use with existing roof construction procedures.

Yet another object of the present invention is to provide a roof securing system which will provide substantial reinforcement beyond what is normally implemented to secure roofing panels to the support beams, thereby assuring that the roofing panels will remain securely in position when subjected to substantial forces.

A further object of the present invention is to provide a roof securing system which is adaptable for use with roofs of varying sizes and dimensions.

Still another object of the present invention is to provide a roof securing system which will not substantially alter or complicate existing roof construction procedures.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
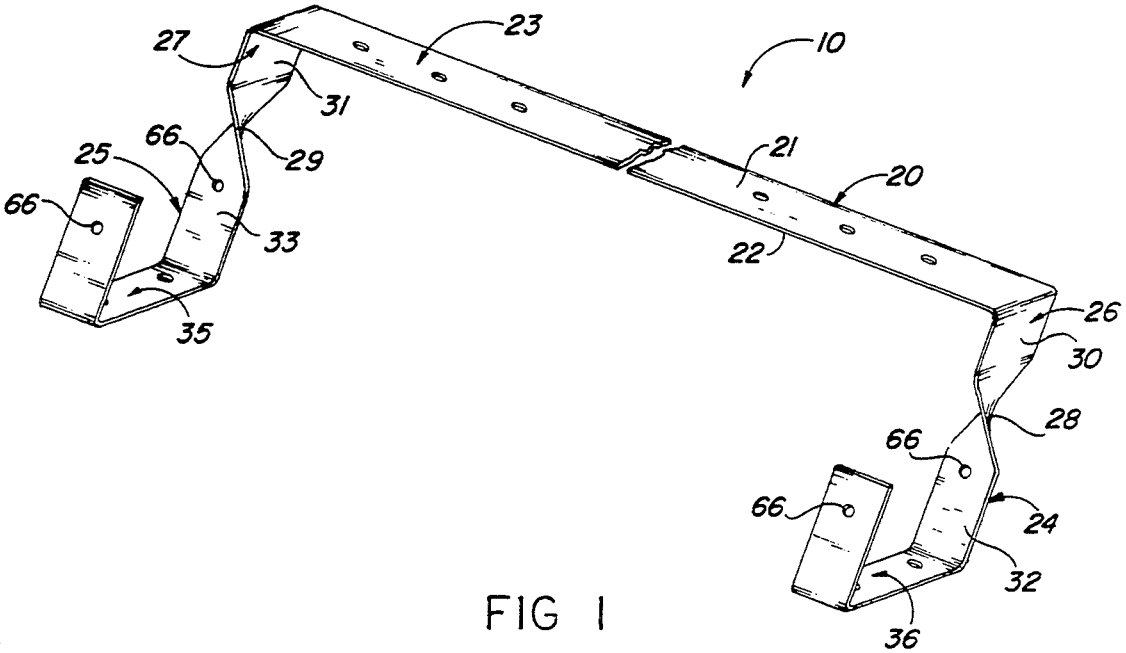
FIG. 1 is a perspective view of the strap of the roof securing system.

Shown throughout FIGS. 1–8, the present invention is directed towards a roof securing system, generally indicated as 10. The securing system 10 is adapted for use on a roof of the type including a plurality of support beams 50 and a number of roofing panels 60. Each of the support beams is of the type having a top face 54, a bottom face 52, and a pair of opposite side faces 51 and 53, the top face 54 being disposed such that a roofing panel 60, including a top surface 61 and a bottom surface 62 is disposed in spanning relation atop the top faces 54 of at least two of the support beams 50. Generally, the roofing panels 60, in the form of a plywood sheet, are secured to the support beams only by 50 a plurality of nails 65 passing therethrough into the support beams 50. The roof securing system 10 of the present invention includes, so as to provide added support, at least one strong, elongate strap 20, preferably formed of 14 gauge or stronger steel. The elongate strap 20 includes a top side 21 and a bottom side 22, and is further defined by a central zone 23 and a pair of oppositely disposed distal zones 24 and 25. The central zone 23 of the strap 20 is adapted to span at least one of the roofing panels 60 in a manner such that the bottom side 22 of the strap 20 matingly overlies the top surface 61 of the panel 60. Further, the length of the central zone is sized and configured to correspond the dimensions of the roofing panel 60 along the length which the central zone 23 overlies. Accordingly, the opposite distal end zones 24 and 25 are adapted to extend downwardly from the central zone 23 so as to substantially straddle the panel 60 along opposite edges thereof. The distal end zones 24 and 25, which define the securing means for the roof securing system 10 are adapted to be rapidly secured about the support beam 50 so as to hold the strap 20 in place. More particularly, the distal end zones 24 and 25 include upper orientation segments 26 and 27 and lower securing segments 35 and 36. In the preferred embodiment, the central zone 23 is disposed to be substantially parallel with the support beam 50, thereby necessitating that the upper orientation segments 26 and 27 properly position the lower securing segments 35 and 36 to matingly engage the support beam 50. The upper orientation segments 26 and 27 each include a centrally disposed twist 28 and 29. The twists 28 and 29 divide the upper orientation segments 26 and 27 into a top portion 30 and 31 and a bottom portion 32 and 33. The top portion 30 and 31 extends downwardly in a substantially perpendicular orientation from the central zone 23 of the strap 20, and if as in the preferred embodiment illustrated in FIGS. 3–7, the central zone 23 is parallel with the support beam 50, neither the top side 21 nor bottom side 22 of the top portion 30 of the upper orientation segment 26 will matingly contact an opposite side face 51 of the support beam 50. Accordingly, the twist 29 is adapted to rotate the bottom portion 33 of the upper orientation segment 27, substantially 90°, thereby resulting in the top side 21 of the lower portion 33 of the upper orientation segment matingly contacting the opposite side face 51 of the support beam 50. As illustrated in FIGS. 3–7, the lower securing segment 35 of the distal end zone 25 extends substantially beyond the bottom face 52 of the support beam 50 and is adapted to be conformingly wrapped about the bottom face 52 and opposite side face 53 of the support beam 50 in a manner such that the top side 21 of the lower securing segment 35 matingly contacts the bottom face 52 and opposite side face 53 of the support beam 50. After being wrapped in place by a hammer 65 or like tool, the distal end zone 25 is securely fastened to the support beam 50 utilizing a plurality of nails 39 passing therethrough into the support beam 50. The nails 39 are adapted to pass through a plurality of openings 66 formed in the strap 20. In an alternative embodiment of the roof securing system 10, the distal end zone 24 and 25 of the strap 20 may be pre-formed to correspond the dimensions of the support beam 50 to which it is to be fastened, rather than necessitating that the lower securing segment 35 be wrapped around the support beam 50.

Figure 2:
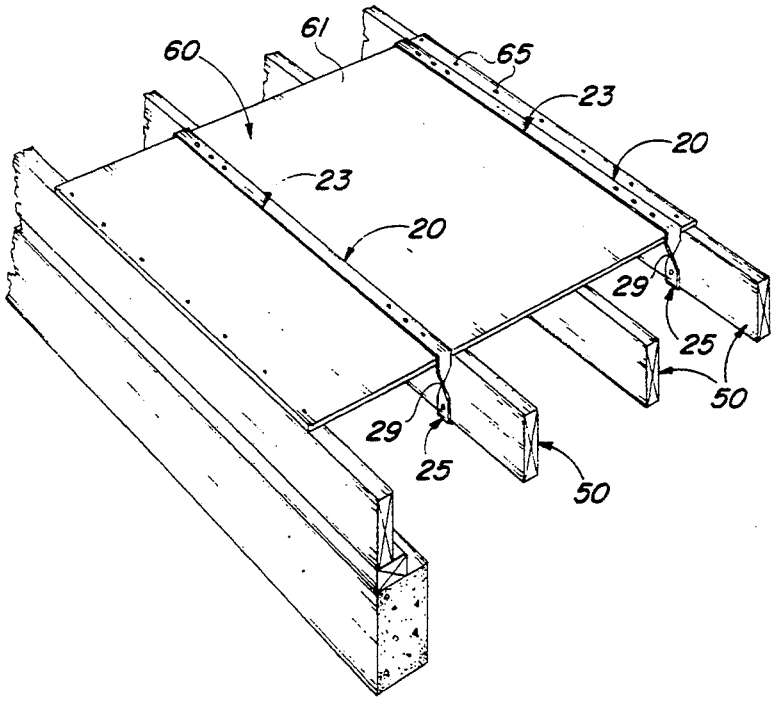
FIG. 2 is a top perspective view of the roof securing system in use over a roofing panel.
Figure 3:
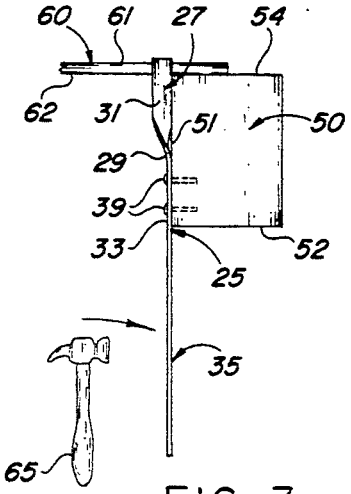
FIGS. 3–7 are a sequential series of side views of the roof securing system illustrating its attachment about a support beam of the roof.
Figure 4:
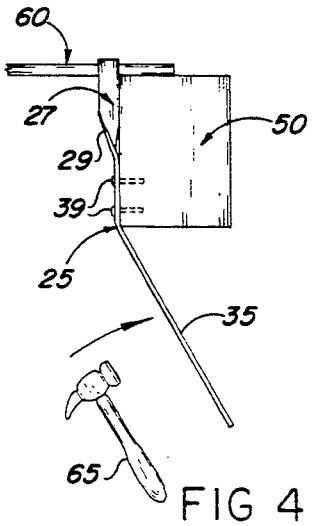
Figure 7:
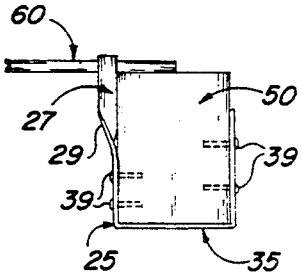
Figure 5:
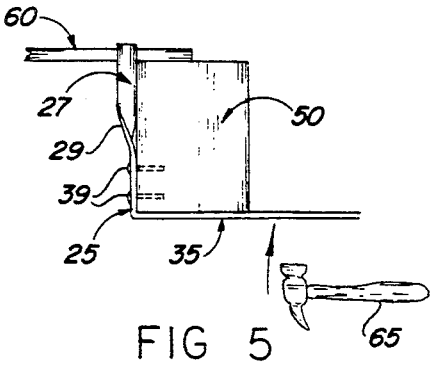
Figure 6:
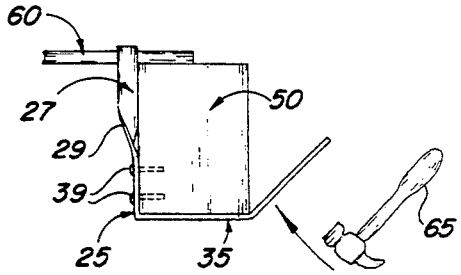
Figure 8:
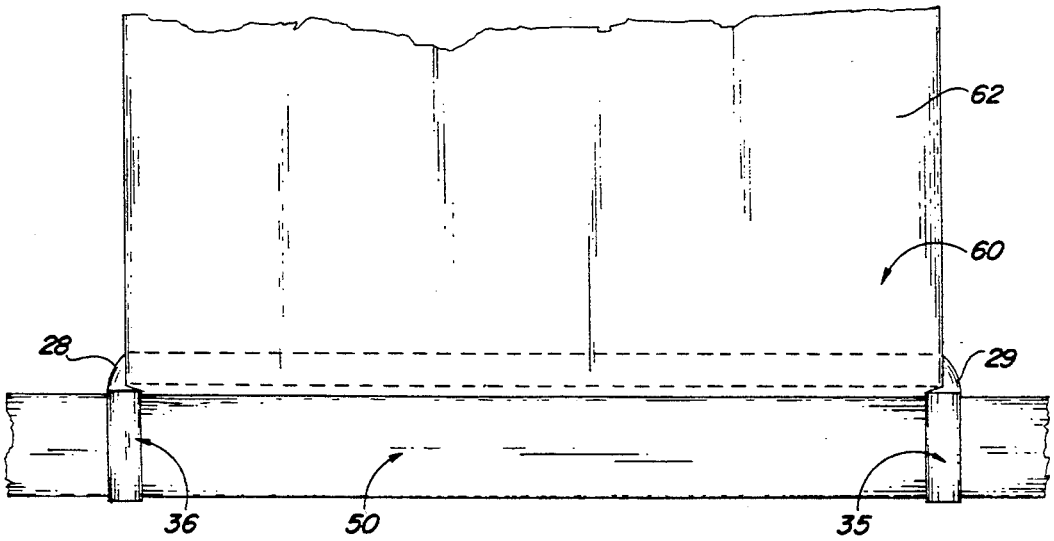
FIG. 8 is a bottom plan view of the roof securing system in use.

As illustrated in FIGS. 2 and 8, the strap 20 of the securing system 10 may be one of a number of straps 20 secured at various points along the panel 60 which overly a support beam 50. The straps 20 apply a substantial downward force on the panel 60 so as to substantially prevent an individual panel 60, upon the exertion of an upward force thereon, from becoming either partially or completely detached from the support beams 50 to which they are secured. Additionally, the thickness of the strap serves as a spacer between adjacent plywood panels for vapor ventilation and to allow for expansion of the panels in humid conditions. Also, in an alternative embodiment, the individual straps 20 may be disposed so as to be substantially perpendicular to the support beams 50, thereby eliminating the need for the presence of the twist 28 and merely requiring that the bottom side 22 of the strap 20 be wrapped directly about the support beam 50 and fastened thereto.

Now that the invention has been described,

What is claimed is:

1. A roof securing system in combination with a roof, wherein said roof including a plurality of support beams, each having a top face, a bottom face, and a pair of opposite side faces, and including a plurality of panels, each having a top surface and a bottom surface, disposed in overlying, spanning relation atop the top face of at least two of the support beams, in order to secure the panels to the support beams; said roof securing system comprising:

at least one strong, elongate strap having a top side and a bottom side, said strap including a central zone, and a pair of oppositely disposed distal zones extending substantially perpendicularly from said central zone, said central zone spanning at least one of the panels such that said bottom side of said strap matingly overlays the top surface of the panel, each of said distal end zones including a lower securing segment extending downwardly from said central zone of said strap conformably wrapped about the bottom face and the side faces of the support beam, and said lower securing segment being securely engaged with the opposite side faces and the bottom face of one of the support beams such that said strap is securely positioned to maintain and securely hold the panel.

2. A roof securing system as recited in claim 1 wherein said strap is disposed such that said central zone of said strap is substantially parallel with the support beam.

3. A roof securing system as recited in claim 2 wherein each of said distal end zones includes an upper orientation segment and said lower securing segment.

4. A roof securing system as recited in claim 3 wherein said upper orientation segment includes a centrally disposed twist defining a top portion and a bottom portion of said upper orientation segment, said twist being structured and disposed to rotate said bottom portion of said upper orientation segment such that said top side of said strap at said bottom portion of said upper orientation segment and said lower securing segment is disposed to matingly contact the opposite side faces and the bottom face of the support beams.

5. A roof securing system as recited in claim 4 further including fastening means structured and disposed to fasten said distal end zone of said strap to the support beam.

* * * * *